United States Patent [19]

Yokoyama

[11] Patent Number: 4,839,952

[45] Date of Patent: Jun. 20, 1989

[54] PROCESS FOR MANUFACTURING TOOTHED PARTS

[75] Inventor: Michihiro Yokoyama, Anjyo, Japan

[73] Assignee: Kabushiki Kaisha Yokoyama Seisakusho, Anjo, Japan

[21] Appl. No.: 68,152

[22] Filed: Jun. 30, 1987

[30] Foreign Application Priority Data

Jul. 3, 1986 [JP] Japan ..... 61-156758

[51] Int. Cl.[4] ..... B21D 53/28

[52] U.S. Cl. ..... 29/159.2; 29/558; 72/335

[58] Field of Search ..... 29/159 R, 159.2, 160.6, 29/557, 558, DIG. 18, DIG. 37; 72/329, 335, 336, 404

[56] References Cited

U.S. PATENT DOCUMENTS

| | | | |
|---|---|---|---|
| 521,178 | 6/1894 | Porter | 29/159.2 |
| 1,725,300 | 8/1929 | Pierson et al. | 72/328 |
| 2,542,912 | 2/1951 | Ensign | 29/159.2 X |
| 3,258,834 | 7/1966 | Rork | 29/159.2 |
| 3,355,930 | 12/1967 | Fedorov | 29/159.2 X |
| 3,381,514 | 5/1968 | Schmidt et al. | 72/335 |
| 3,596,493 | 8/1971 | Lachaussee | 72/335 |
| 3,635,067 | 1/1972 | Hanas | 72/336 X |
| 3,688,549 | 9/1972 | Ohnishi | 29/159.2 X |
| 3,694,127 | 9/1972 | Takahashi et al. | 425/352 |
| 3,760,623 | 9/1973 | Hempelmann | 72/336 |
| 4,050,283 | 9/1977 | Schober | 29/159.2 X |
| 4,111,031 | 9/1978 | Vennemeyer et al. | 29/159.2 X |
| 4,290,292 | 9/1981 | Yoneda | 72/356 X |
| 4,509,353 | 4/1985 | Ike et al. | 29/159.2 X |
| 4,672,729 | 6/1987 | Hoguchi et al. | 29/159.2 |

FOREIGN PATENT DOCUMENTS

| | | | |
|---|---|---|---|
| 516674 | 4/1921 | France | 29/159.2 |
| 12-16831 | 10/1937 | Japan | 29/159.2 |
| 49-79945 | 8/1974 | Japan . | |
| 55-141348 | 11/1980 | Japan . | |
| 57-14439 | 1/1982 | Japan . | |
| 58-58952 | 4/1983 | Japan . | |
| 58-47929 | 10/1983 | Japan . | |
| 59-76639 | 5/1984 | Japan . | |
| 60-37237 | 2/1985 | Japan . | |
| 60-261638 | 12/1985 | Japan . | |
| 61-30251 | 2/1986 | Japan . | |
| 0590053 | 1/1978 | U.S.S.R. | 72/336 |
| 618172 | 6/1978 | U.S.S.R. . | |
| 978997 | 12/1982 | U.S.S.R. . | |

*Primary Examiner*—Timothy V. Eley
*Assistant Examiner*—Frances Chin
*Attorney, Agent, or Firm*—Burns, Doane, Swecker & Mathis

[57] ABSTRACT

A process for manufacturing toothed parts having a tooth profile on a portion of their outline. The process utilizes a press machine having top and bottom die sets with stock interposed therebetween at uniform intervals in sequence with the vertical operation of the press machine. The process includes a first step wherein a center hole is stamped in said stock and, a second step wherein a window hole corresponding to the exterior peripheral tooth profile is stamped in said stock using the center hole as a reference, a third step wherein a tooth profile having a tooth width greater and a tooth height lower than the final tooth profile is rough-formed on one side of said window hole, and a fourth step wherein the exterior periphery of said rough-formed toothed part undergoes stamping and ironing operations concurrently with the processing of the final tooth profile.

1 Claim, 4 Drawing Sheets

PROCESS FOR MANUFACTURING TOOTHED PARTS

BACKGROUND OF THE INVENTION

The present invention relates to a process for manufacturing a toothed part having on a portion of its exterior circumference a tooth profile of a required modular or optional shape.

DESCRIPTION OF THE PRIOR ART

Although toothed parts are conventionally manufactured by fine-blanking methods employing expensive specialized press machines, mass production of said parts is made difficult by the fact that the toothed portions of the metal punch and die are not durable.

SUMMARY OF THE INVENTION

An object of the present invention is to provide a process for manufacturing toothed parts having a mass-production capability.

A further object of the invention is to provide a process for manufacturing toothed parts wherein the toothed portions of punches and dies have superior durability.

A still further object of the invention is to provide a manufacturing process wherein high precision toothed parts which are not susceptible to shear drop or cracking can be manufactured using an inexpensive, general-propose press machine.

In order to accomplish the aforementioned objects, the present invention provides a process for manufacturing toothed parts comprising a press machine having top and bottom die sets with stock interposed therebetween at uniform intervals in sequence with the vertical operation of the press machine. The process includes a first step wherein a center hole is stamped in said stock and, a second step wherein a window hole corresponding to the exterior peripheral tooth profile is stamped in said stock using the center hole as a reference, a third step wherein a tooth profile having a tooth width greater and a tooth height lower than the final tooth profile is rough-formed on one side of said window hole, and a fourth step wherein the exterior periphery of said rough-formed toothed part undergoes stamping and ironing operations concurrently with the processing of the final tooth profile.

In accordance with the aforesaid construction, great force is not applied to the punches and dies in comparison to the force used in processes wherein the tooth profile, the outline and the center hole are all punched simultaneously, thereby making damage to the dies induced by the applied force unlikely, rendering the manufacturing of toothed parts very simple, and also making for durable dies.

Other and further objects, features and advantages of the invention will become more fully apparent from the following description.

DETAILED DESCRIPTION OF THE PREFERRED EMBODIMENTS

The processes of the present invention are hereinafter described via the construction and operation of devices employing said processes.

Figure 1:
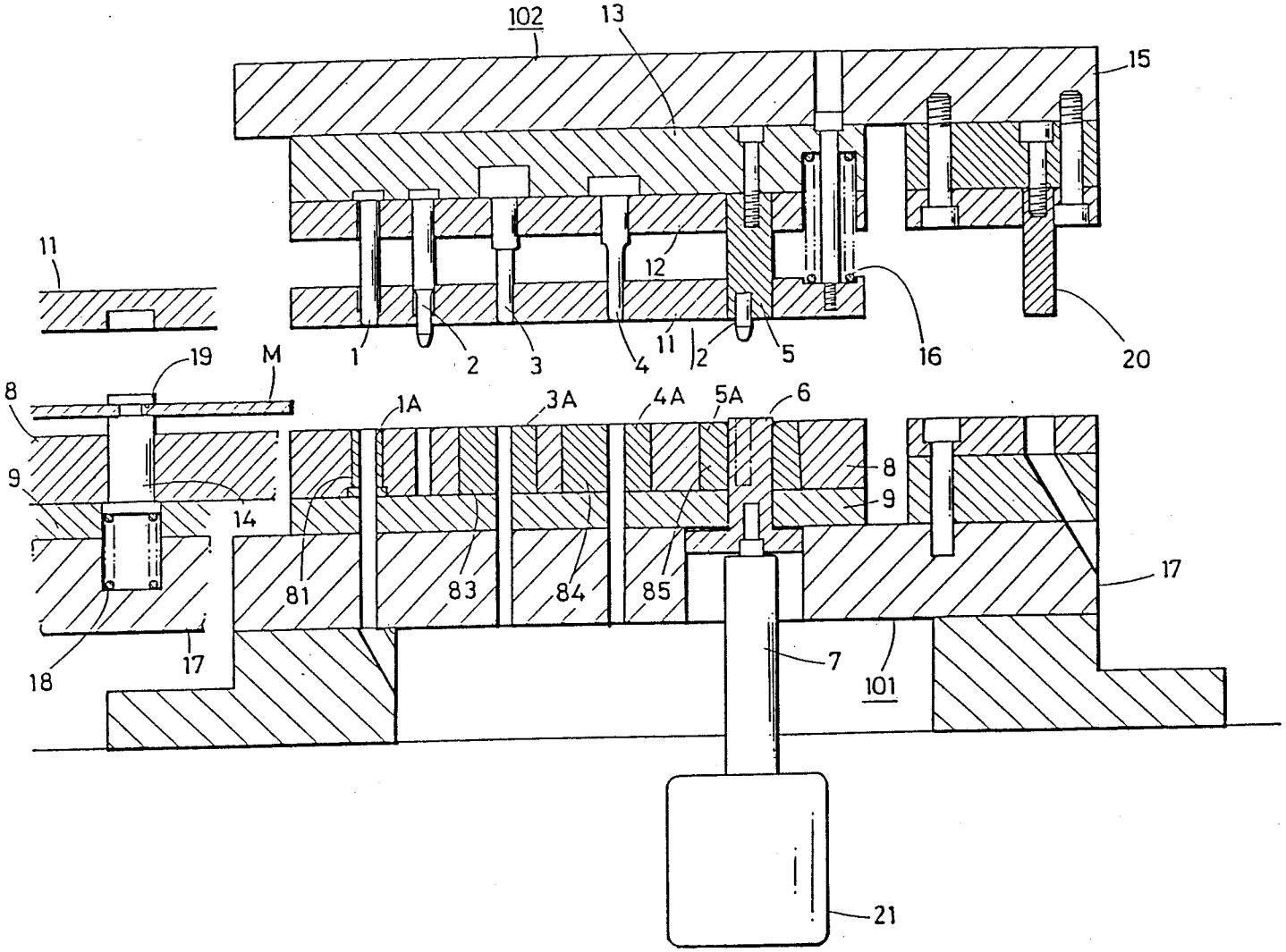
FIG. 1 is a cross sectional view showing the top and bottom die sets in an embodiment of the present invention.
Figure 2:
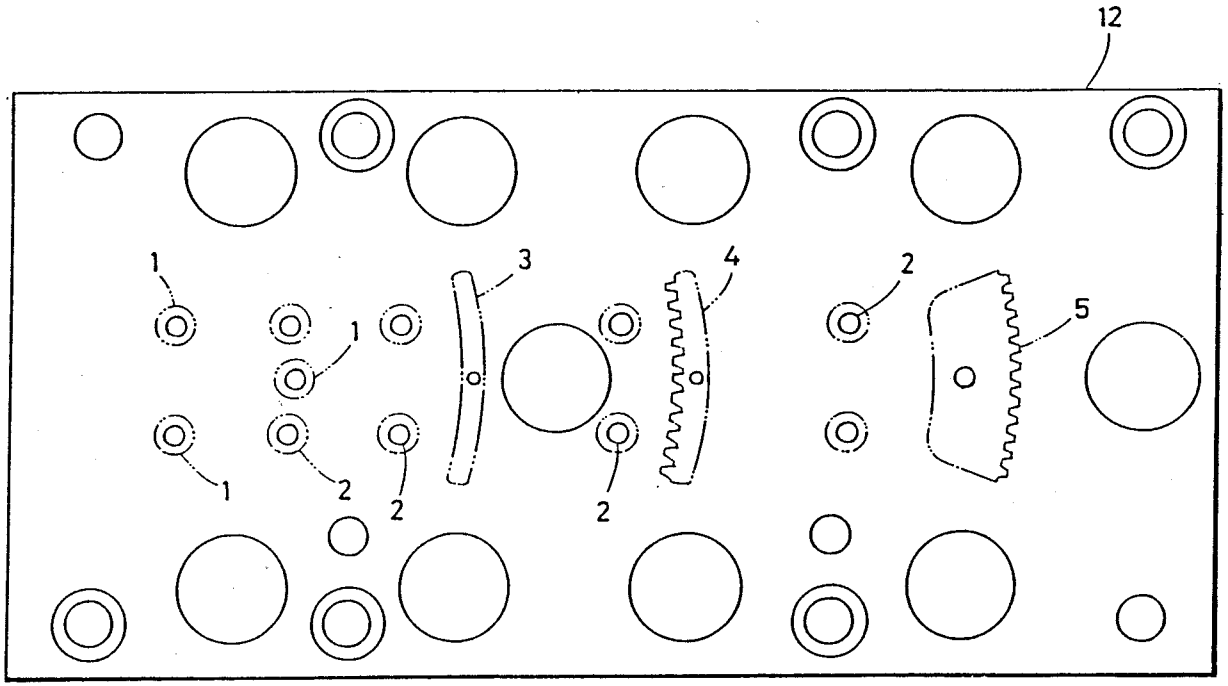
FIG. 2 is a bottom view showing the punch holder.
Figure 3:
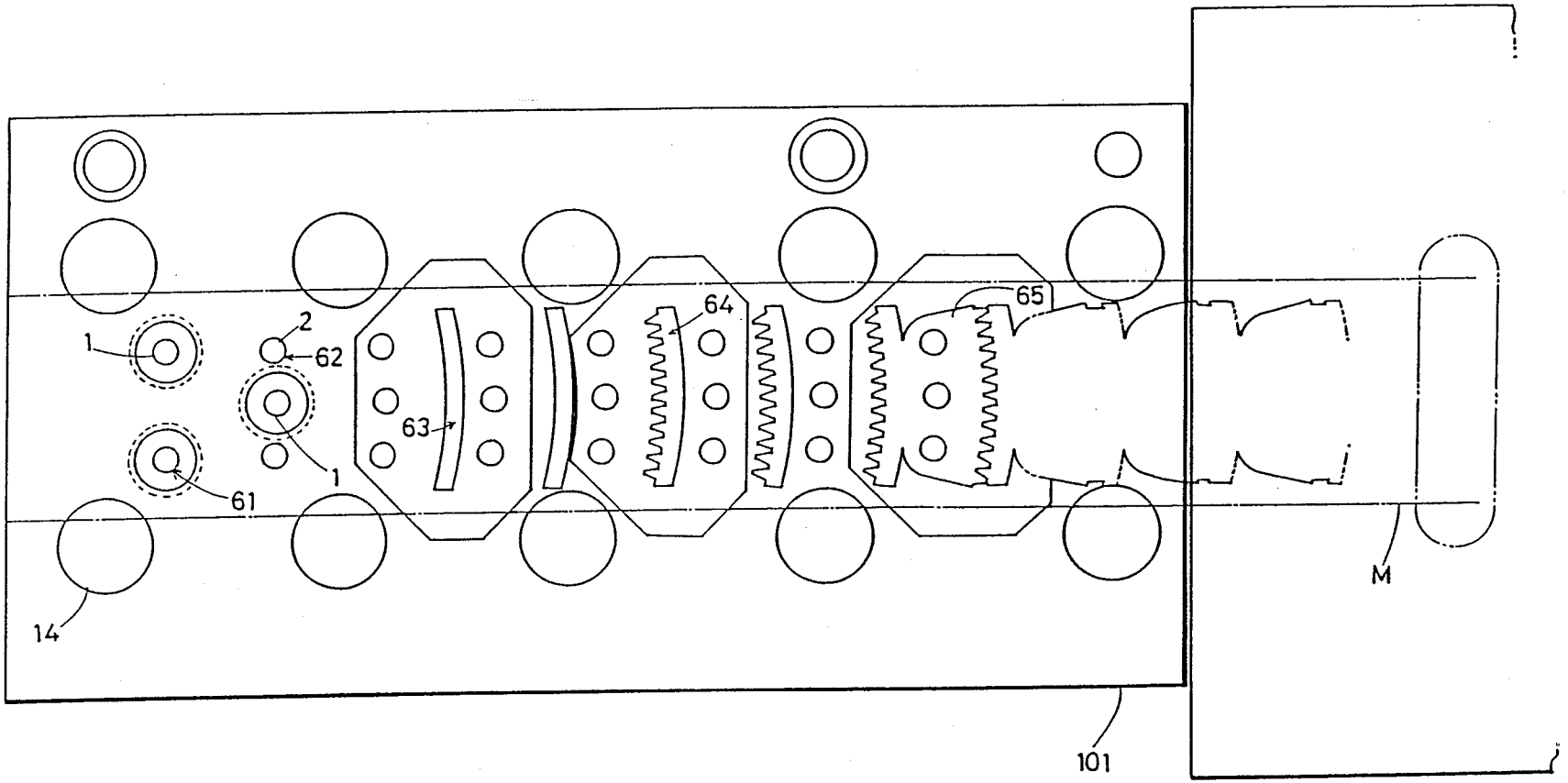
FIG. 3 is a plan view of the bottom die showing the processing state.

As shown in FIGS. 1 to 3, top die set 102 has a center hole punch 1 mounted thereto at the front of punch holder 12 of said top die 102 for the purpose of punching center hole 61 in toothed part 51, and pilot punch 2 for punching pilot hole 62, window hole punch 3, rough-forming tooth punch 4, and finish punch 5 are thereafter sequentially positioned. Pilot punch 2 comprises a total of ten punches in order to provide precise punch positioning. Window hole punch 3 is provided for punching window hole 63 in stock M at a location appropriate to the exterior periphery of the formed teeth, said window hole 63 being arc-shaped in the example. Rough-forming tooth punch 4 is provided for punching a rough-formed tooth profile 64 having teeth with a width greater and height lower than the final tooth profile on the interior periphery of the aforesaid window hole 63. Finish punch 5 is provided for forming the aforesaid rough-formed teeth into the final tooth profile while stamping and ironing the outline shape of the toothed part.

The advantage of each process lies in the fact that the manufactured toothed part 51 outline and center hole cuttings are precision-finished concurrently, the angular tip of center hole punch 1 of the first process having a curved face provided thereon. The radius of said curved face depends on the diameter of punch 1, but is 3–15% of said diameter. The tips of window hole punch 3 and rough-forming tooth punch 4 also have affixed thereto identical curved faces. The tip of finishing punch 5 forms a right angle.

Punch holder 12 having the aforesaid punches 1–5 mounted thereon is itself mounted to the top table of the press machine via punch plate 13 and top plate 15. Stripper plate 11 is mounted below punch holder 12 via a spring 16, polyurethane rubber or other elastic member.

Bottom die set 101 is mounted to the bottom table of the press machine via wear plate 17 and bottom form die holder 9 holding female die 8. Die bushings 81, 83, 84 and 85 are mounted on female die 8 at positions corresponding to the insertion positions of center hole punch 1, window hole punch 3, rough-forming tooth punch 4 and finish punch 5, respectively. A finishing counter 6 is inserted in the bore of female die 8 of die bushing 85 which is positioned in opposition to finish punch 5, the underside of said finishing counter 6 having cushion pin 7 connected thereto. Lifter pin 14 has an underhead ring slot 19 provided laterally to die bushings 81, 83, 84 and 85 in female die 8, said lifter pin 14 being projected in an upward direction by means of an elastic member 18.

In the present embodiment, the outline of finishing counter 6 notches the tooth profile in an identical shape to that formed by finished punch 5. The underside of finishing counter 6 has cushion pin 7 connected thereto, and at the bottom of said cushion pin 7 is provided a pressure device 12 which is actuated via gas pressure or a hydraulic cylinder and which also has a two-stage switching capability. Cushion pin 7 is normally actuated in an upward direction by pressure device 21 at a reasonable pressure of approximately 2–50 tons; when stock M, which hereafter becomes partially fabricated item 50, is forced into die bushing 85 by finishing counter 6 and undergoes an ironing operation, the force applied via pressure device 21 can be greatly increased 5–10 fold over the normal range of 2–50 tons. The press machine used in the present embodiment is of a typical type, modified only in that pressure device 21 is provided thereto.

Figure 4:
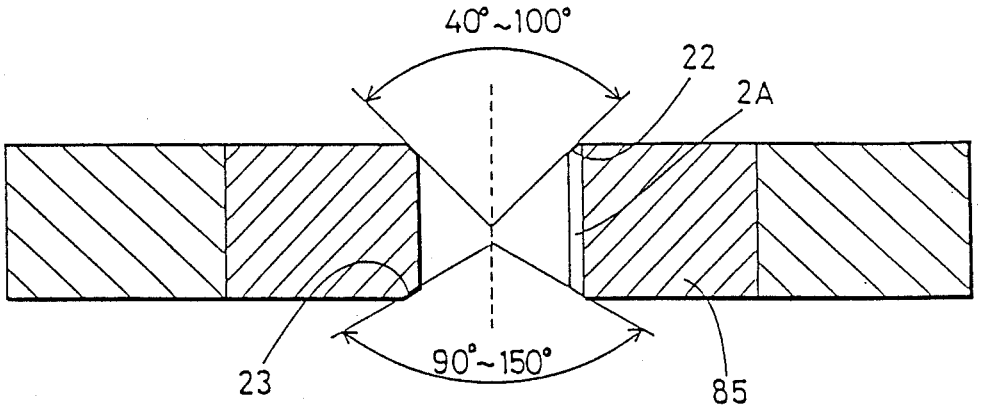
FIG. 4 is cross sectional view showing the finish die bushing in the female die.
Figure 5:
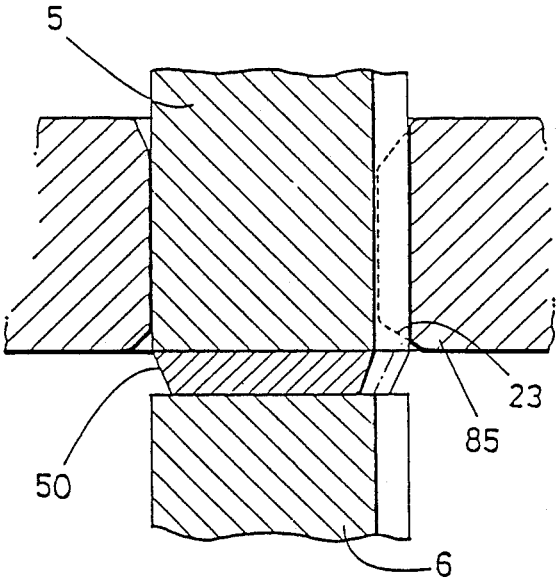
FIG. 5 is a cross sectional view showing the finish die bushing and the partially fabricated item at completion of the downward stroke and prior to the upward stroke.

A 40°–100° chamfer 22 is provided uniformly around the entire circumference of the upper inlet to die bushing 85 as shown in FIG. 4 in order to markedly reduce the frictional resistance at the inlet to said die bushing 85 because die bushing 85 or finish punch 5 can be easily damaged due to the greater force applied to said inlet during formation of the tooth profile, also chamfer 22 must be attached to both the vertical and horizontal surfaces of die bushing 85 via the minutely curved surface of the diameter. Because the angle of chamfer 22 may be changed according to the thickness of the stock M, appropriate angles in the range of 40°–100° can be determined through experimentation. Also, in order to avoid a concentration of pressure, it is desirable that chamfer 22 and the minutely curved surface be specially mirrored surfaces. As shown in FIGS. 4 and 5, a chamfer 23 having a moderate slope of 90°–150° is provided at the lower inlet of die bushing 85.

[Operation]

The operation of the present embodiment is hereinafter described according to the aforesaid construction and with reference to FIGS. 1 to 6.

The die shown in FIG. 1 is a progressive feed-type die which processes coiled stock M in a left-to-right manner, feeding said stock M at a uniform intervals. Stock M is inserted in ring slot 19 under the head of lifter pin 14 and fed therefrom. In the first step, center hole 61 is punched in the toothed part 51, which is the product, via center hole punch 1, and pilot hole 62 is also punched via pilot hole punch 2 as shown in FIG. 3. Next, in the second step, the arc-shaped window hole 63, which is appropriate for the exterior perimeter of the toothed region, is stamped in stock M via window hole punch 3. Thereupon, in the third step, the rough-formed teeth 64 are stamped in stock M adjacent to the aforesaid window hole 63 via the rough-forming tooth punch 4. In said steps 1 through 3, punch debris from stock M transits the bore of die bushings 81, 83 and 84, and descends through bottom die set 101, and although cracks and burrs appear in said punch debris, the same do not appear in stock M at center hole 61, pilot 62, window hole 63 or rough-formed teeth 64 which have a good cutting plane and are formed by means of punches 1, 2, 3, 4, etc., all of which have curved faces at their tip. The fact that stripper plate 11 exerts pressure on stock M on the top of female die 8 is also instrumental in the precision stamping of stock M. Thereafter, stock M is easily fed at a specified uniform interval via a feed gear because said stock M is raised from the top face of female die 8 by means of an elastic member 18 each time top die set 102 rises.

Finish punch 5 and finishing counter 6 are provided with stock M fed therebetween, its positioning determined by means of pilot punch 2, and when top die set 102 descends pressure is applied to said stock M in both upward and downward directions, e.g., in a downward direction by means of descending finish punch 5 and in an upward direction by means of pressure applied by the pressure device 21-actuated finishing counter 6, said stock M being pushed by means of the great downward pressure applied from above via punch 5, said downward pressure applied from above via punch 5 being greater than the pressure applied in an upward direction from below via counter 6 and resulting in some punch debris generation during the punching operation, and said punched stock M thus entering die bushing 85. At this time, greater force is exerted on the inlet of die bushing 85, but because chamfer 22 is provided thereto connected via a curved surface as shown in the aforementioned FIG. 4, stock M is able to transit said chamfer 22 with comparatively slight frictional resistance. Punched stock M transits chamfer 22 of die bushing 85 and is forced entirely into said die bushing 85, the aforesaid punch 5 descending so as to force punched stock M to transit die bushing 85. A comparatively slow speed of descent for punch 5 is most suitable for the formation of the tooth profile. At such time as punch 5 attains the end point of descent, the underside of finish counter 6 may make contact with some member via the force exerted by said punch 51, and since punch 5 can be easily damaged should sufficient force be applied, the underside of counter 6 is left open in order that such damage may be avoided and assure that counter 6 does not come into contact with another member. Punch 5 rises after attaining the end point of descent.

A high precision toothed part 51 is difficult to produce because partially fabricated item 50, having a punched tooth profile formed thereon by means of the pressure exerted by the aforesaid finish punch 5, has some trimming taper as shown in FIG. 5 and its major diameter may expand 5% due to spring back.

Figure 6:
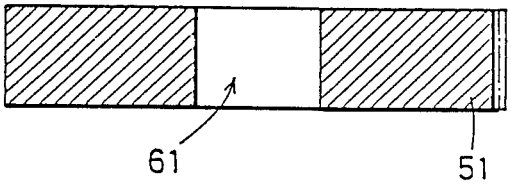
FIG. 6 is a cross sectional view showing the manufactured toothed part.

Thus, by switching pressure device 21, which has a two-stage switching capability, to high-pressure operation and with partially fabricated item 50 positioned on counter 6, vertical pressure is applied via punch 5 and counter 6 in reverse orientation to the aforesaid downward motion, partially fabricated item 50 is forced into die bushing 85 via the great pressure exerted in the opposite direction by counter 6, and said item 50 is moved upward to remove the trimming taper by transiting said die bushing 85 in an upward direction. During this upward movement, the moderately sloping face of chamfer 23 at the bottom inlet to die bushing 85 works effectively, and partially fabricated item 50 having a trimming taper thereon is smoothly inserted into die bushing 85 via counter 6, a deburring operation is performed, and as shown in FIG. 6 a high-precision toothed part 51 with the trimming taper compltely removed is produced with each upward stroke of finish punch 5 and counter 6.

Thereafter, a toothed part 51 is individually produced with each reciprocal motion of top die set 102. Stock M which has transited top and bottom die sets 102 and 101 is cut into pieces by cutting punch 20 and thereafter ejected.

Although the invention has been described in its preferred form with a certain degree of particularity, it is understood that the present disclosure of the preferred form has been changed in the details of constructions and the combination and arrangement of parts may be resorted to without departing from the spirit and the scope of the invention as hereinafter claimed.

What is claimed is:

1. A process for manufacturing toothed parts having an exterior periphery defining a final tooth profile that is comprised of a finished smooth profile portion and a finished tooth profile portion and said process for manufacturing including the use of a press machine having top and bottom die sets with stock interposed therebetween at uniform intervals in sequence, said process including the steps of:

stamping a reference hole in said stock;

stamping a window hole defined by a front profile line and a back profile line substantially similar to the toothed parts in said stock while using said reference hole as a reference;

rough-forming on the back profile line of said window hole a tooth profile having a tooth width greater and a tooth height lower than the final tooth profile, the rough-formed tooth profile on one side of said window hole having a shape substantially similar to the finished tooth profile portion, and the front profile line of said window hole having a shape substantially similar to the finished smooth profile portion;

stamping a partially fabricated part through a die bushing in a female die with a finish punch that has a shape similar to that of the toothed parts, the die bushing through which said partially fabricated parts is passed having a 40°–100° chamfer around substantially an entire circumference of an upper inlet and a 90°–150° chamfer at a lower inlet of the die bushing; and ironing said partially fabricated part with a finishing counter and thereby notching the tooth profile in a substantially identical shape to the tooth profile formed by said finish punch.

* * * * *